United States Patent [19]

Johnson

[11] 4,204,469

[45] May 27, 1980

[54] CARTON BRANDER

[76] Inventor: John A. Johnson, Rte. 1, Box 614-C, New Richmond, Ohio 45157

[21] Appl. No.: 918,926

[22] Filed: Jun. 26, 1978

[51] Int. Cl.[2] ..... B44B 7/00; B65B 61/26

[52] U.S. Cl. ..... 101/9; 101/93.35; 53/131; 156/583.1

[58] Field of Search ..... 53/131, 375; 101/9, 101/27, 93.31, 93.32, 93.33, 10, 11, 93.35; 219/216, 243; 156/583.1

[56] References Cited

U.S. PATENT DOCUMENTS

| | | | |
|---|---|---|---|
| 1,035,358 | 8/1912 | Keller | 173/133 X |
| 2,787,210 | 4/1957 | Shephard, Jr. | 101/93.33 |
| 3,322,063 | 5/1967 | Hida et al. | 101/93.33 |
| 3,331,320 | 7/1967 | Young et al. | 101/27 X |
| 3,509,623 | 4/1970 | Stauer | 101/93.33 |
| 3,584,574 | 6/1971 | Smith | 101/93.33 |
| 3,822,641 | 7/1974 | Babler | 101/93.31 |
| 3,872,646 | 3/1975 | Johnson | 53/131 |
| 3,922,964 | 12/1975 | Fischer | 53/131 |
| 3,956,871 | 5/1976 | Johnson | 53/131 X |

*Primary Examiner*—John Sipos
*Attorney, Agent, or Firm*—Wood, Herron & Evans

[57] ABSTRACT

A carton brander including an anvil, a heated dater block, an actuating cylinder for moving the dater block toward the anvil to brand carton flaps therebetween, and interposer apparatus isolating the cylinder from the heat of the dater block. The interposer comprises a longitudinally slidable rod extending between the cylinder's piston and the movable dater block. The rod is shorter than the distance between the retracted piston and the dater block, isolating the cylinder from heat conduction from the dater block.

28 Claims, 6 Drawing Figures

CARTON BRANDER

This invention relates to marking apparatus for applying date indicia to containers for perishable goods such as milk. More particularly, this invention relates to a container branding apparatus particularly useful with the dairy machines manufactured by the Ex-Cell-O Corporation, under model numbers QL9000, QL4500, QR2D and QP, for filling and sealing milk cartons.

Carton branders, per se, are well known in the prior art, for example, as disclosed in U.S. Pat. Nos. 3,872,646, 3,956,871 and 3,956,872, all of which are incorporated herein by reference. With the advent of new, faster production machines such as the described Ex-Cell-O equipment, however, new carton daters, capable of operating at the faster speeds of the new machines, are desirable.

In this connection, and with regard to required speed of operation in these new machines, it is desirable to utilize a fast-acting cylinder controlled apparatus to move a heated date stamp against a carton flap for branding. In other branders such date stamps are typically carried in heated dater blocks and are changed daily. If an air cylinder was to be used in close proximity with the dater blocks (which are heated sufficiently to brand a carton flap), however, the heat would tend to degrade the cylinder seals and otherwise detract from the useful life of the cylinder, particularly for example, if the hot dater block was connected directly or is close to the cylinder's piston.

Moreover, connecting the heated dater block directly to the cylinder's piston would result in alignment and operational difficulties, including the required removal and change of dates from day to day. In such a construction, the piston would sustain all the stress imparted by the dater block, and would bind upon misalignment.

Accordingly, it has been an objective of this invention to provide improved branding apparatus for use with milk carton filling and sealing apparatus.

A further objective of the invention has been to provide a brander useful with various Ex-Cell-O Corporation milk carton machines designated as model numbers QL9000, QL4500, QR2D and QP.

A further objective of the invention has been to provide a cylinder actuated brander having a pneumatic actuating cylinder which is effectively isolated from undue heat, stress and alignment problems.

To these ends, a preferred embodiment of the invention comprises a heated dater block, operatively aligned with an anvil for branding carton flaps therebetween, an actuating air cylinder and an actuating rod interposed between the cylinder and dater block to isolate the cylinder from excessive heat and yet permit intermittent mechanical actuation of the dater block toward the anvil for branding. The actuating rod is reciprocally mounted in a relatively short guide tube in line with the dater block on one end and a pneumatic cylinder on the other. When selectively engaged at a rearward end by the extended piston of the pneumatic cylinder, the rod slides forward, engages the dater block, and moves it toward the anvil for branding a carton flap. The rod is shorter than the distance between the retracted piston and the dater block and there is normally no direct connection of the cylinder to the heated dater block, thus no undue heat is imparted to the cylinder. Also, the rod is relatively loosely fit in the guide tube for free sliding movement and the cylinder piston does not extend into the tube. Alignment of the cylinder with the rod and guide tube is not particularly critical and undue stress and binding on the cylinder piston is eliminated.

Another feature of the invention lies in the in-line mounting of the cylinder piston axis, rod axis and anvil on the same tie member. All operating forces are closely parallel, to the member, further contributing to the efficient operation of the improved brander. In this regard, the cylinder axis, rod axis and the anvil are each mounted as closely as possible to the common tie bar, with the movable heated dater block mounted on a spring between the anvil and rod. Forces exerted by the cylinder on the actuating rod, dater block, and then the anvil are parallel and very close to the tie bar, thus further contributing to smooth operation without undue binding, stress or springing of the cylinder or other components.

Moreover, the tie bar is mounted at the top of an upstanding column extending downwardly to a position where it is mounted to a frame member. The heated dater block is also mounted on a frame member, by a leaf spring, thus providing a substantial distance through structural parts from the dater block to the cylinder and significantly restricting the conduction of heat from the dater block to the cylinder.

This construction thus incorporates several unique features which combine to produce unique advantageous results not available in prior brander constructions.

The length of the separate actuating rod isolates the cylinder from the radiated heat of the dater block, while the interposed rod permits a structural discontinuity between the heated dater block and air cylinder when the piston is retracted to restrict heat conduction to the cylinder, and yet provides selective mechanical actuation through the rod where cylinder piston alignment is not critical. This avoids binding and stressing of the cylinder's piston, and promotes long cylinder life. Also, the bar is short enough so that when the cylinder piston is retracted, the bar can be moved rearwardly to facilitate the daily change in the dates of the dater block.

These and other objects and advantages will become readily apparent from the following detailed description of a preferred embodiment of the invention and from the drawings in which.

Figure 6:
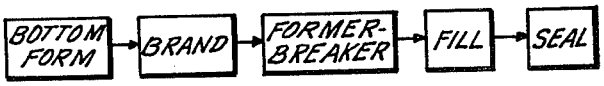
FIG. 6 is a diagrammatic chart showing the general position of the invention in a typical milk carton filling and sealing apparatus.

Turning now to the drawings, and first particularly to FIG. 6 thereof, it will be appreciated that the present invention could be utilized in connection with a number of different carton filling and sealing machines. The invention is particularly useful, however, with the Ex-Cell-O carton filling and sealing machines model numbers QL9000, QL4500, QR2D and QP. As shown in FIG. 6, these dairy machines provide for the forming, filling and sealing of a carton. Primarily, they are intended for dairy use where polyethylene coated paperboard milk cartons are formed, filled with milk, and then sealed for consumer use. In the specific Ex-Cell-O machines identified above, the present invention is disposed within the machines at a branding station between the bottom forming station of the machine and the carton top former-breaker. Thus, the present invention comprises a branding station at this location in such machines as diagrammatically illustrated in FIG. 6. Of course, the invention may be adapted for use with other machines. In these machines, however, mounting of the brander at this general location is desirable since there is typically space for the brander at a position where the carton conveyor in the machine is momentarily stopped with cartons thereon having a free standing upright flap for branding.

Figure 1:
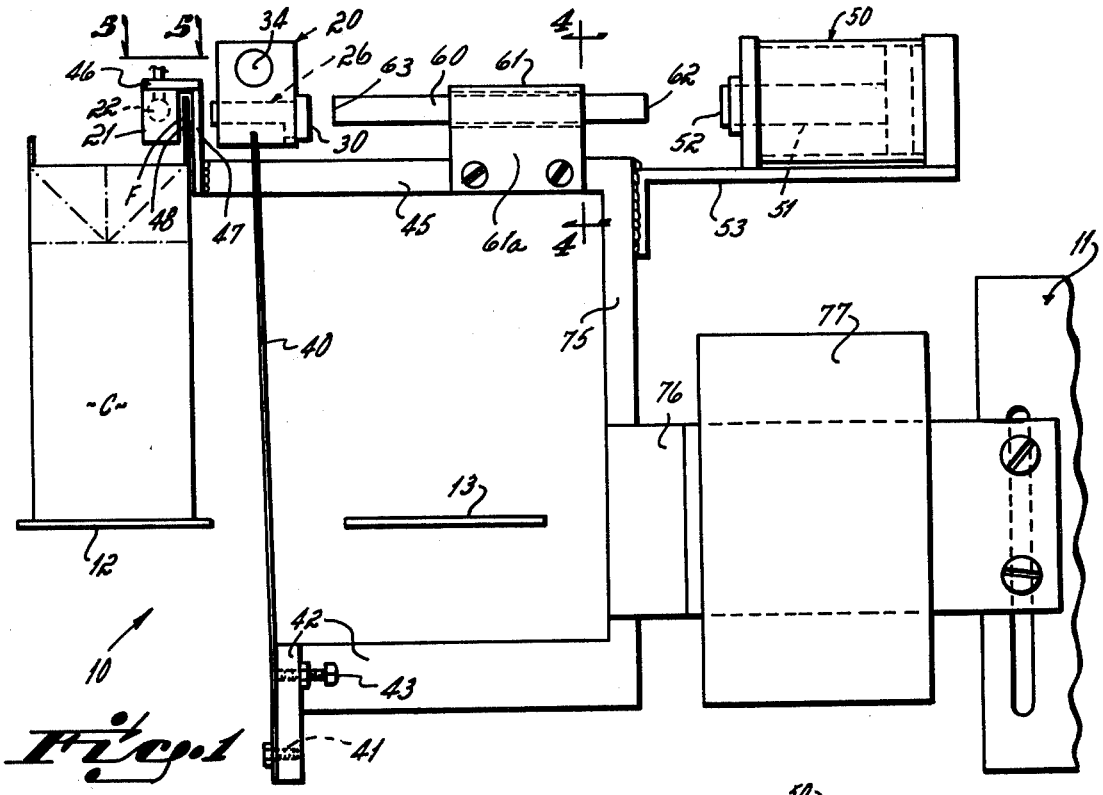
FIG. 1 is a side view of a preferred embodiment of the invention.

Now considering FIG. 1 of the drawings, a preferred embodiment of the invention comprising brander 10 is connected to a carton forming, filling and sealing machine 11, preferably between the bottom forming and top former-breaker stations of the machine. The machine 11 includes a conveyor having a feed run 12 for conveying cartons through the various stations of the machine in machine direction MD (FIG. 5), and a return run 13.

FIG. 1 is a view taken through the machine showing a carton C on the feed run 12 of the conveyor. In this position, the carton C has a top structure including at least one upstanding flap F which is to bear the date brand.

Figure 3:
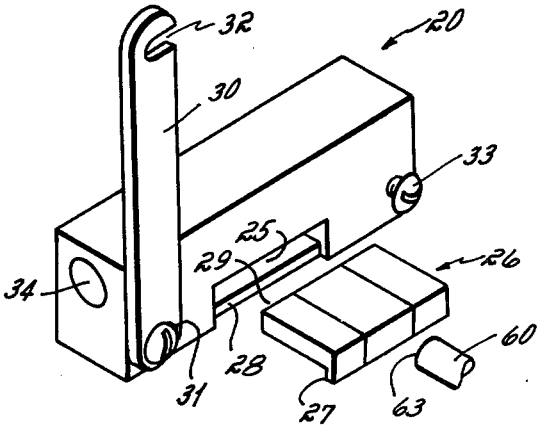
FIG. 3 is a perspective view of the dater block of the invention illustrating date die removal and actuating rod positions.

The apparatus 10 includes a heated dater block 20 and a water-cooled anvil 21 having a water passage 22 and water inlets and outlets 23 and 24. Referring to FIG. 3, the dater block 20 includes a recess 25 for receiving date dies or slugs 26 therein. As shown in FIG. 3, the date dies 26 have depending legs 27 on a rearward end thereof. When the dies are in place, the depending legs 27 engage the surface 28 on the dater block 20 to appropriately position the dies and to restrain them from moving forwardly. The forward ends 29 of the date dies, as seen in FIG. 1, extend forwardly of the dater block 20 a slight distance for engaging and branding the carton flap F. To this end, the forward ends 29 of the date dies comprise raised numerals or letters which are indicative of a particular date.

The dater block 20 also includes a swing gate 30, pivoted at 31, to hold the date dies in place in the position shown in FIG. 1. Swing gate 30 includes a slot 32 fitting over a screw 33 in the dater block 20 for securing the gate 30 and maintaining the date dies 26 against rearward motion.

Figure 2:
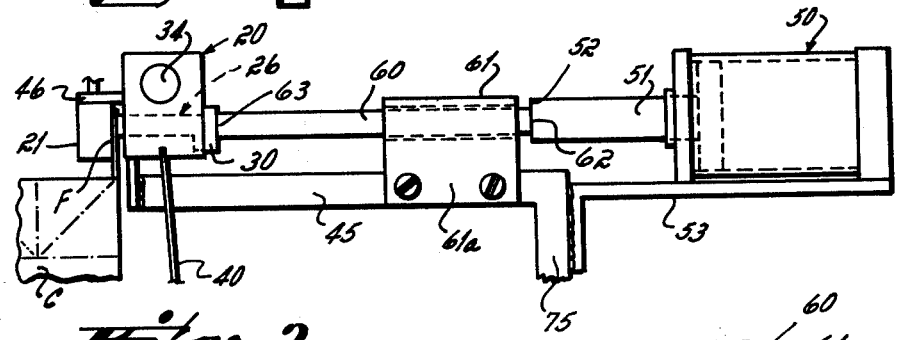
FIG. 2 is a side view similar to FIG. 1 but showing the invention in a branding position.
Figure 4:
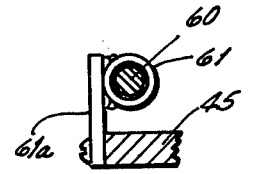
FIG. 4 is a view taken along lines 4—4 of FIG. 1.

The dater block 20 further includes a bore 34 for receiving an appropriate heater (not shown). One suitable heater is that described in U.S. Pat. No. 3,956,872. When the heater is energized, it heats the complete dater block 20 and the date dies 26 to a sufficient temperature such that when the dies 26 are pressed against the carton flap F, date indicia is burned into the carton flap. The dies 26 are also particularly described in U.S. Pat. No. 3,956,872. By way of example, FIG. 2 illustrates the engagement of the date dies with the carton flap F, backed up by the anvil 21, and at which time the date indicia is burned into the outer surface of the carton flap F by the date slugs or dies.

As further shown in FIG. 1, the dater block 20 is securely mounted on the upper end of a leaf spring 40, the spring extending into a slot cut into the dater block 20. While shown in a central area of the block 40 the spring could be mounted flush with the rear of the block 20. The lower end of the leaf spring 40 is attached by means of screws 41 to an L-shaped frame member 42 of the branding apparatus. Frame member 42 extends in a rearward direction.

In order that the position of the dater block 20 can be adjusted with respect to the anvil 21, an adjusting bolt 43 is provided in the frame member 42. When the bolt is turned forwardly into the frame member, its forward end engages the leaf spring above the screw 41 and bends the spring forwardly thereby moving the dater block 20 toward the anvil 21. Once adjusted, spring 40 normally holds dater block 20 and the date dies 26 slightly spaced from the anvil 21, and at a distance sufficient to permit carton flap F to be conveyed between the dater block 20 and the anvil 21.

Figure 5:
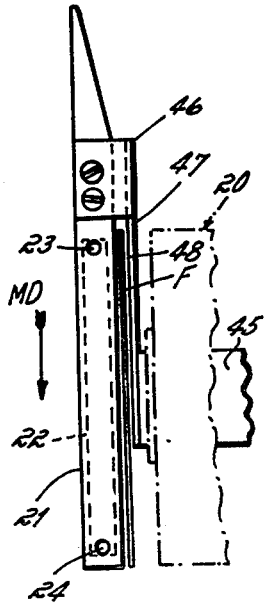
FIG. 5 is a view taken along lines 5—5 of FIG. 1.

Further, it will be appreciated that the dater block 20 is movable with respect to the anvil 21 which is stationarily mounted. Specifically, anvil 21 is mounted to a tie bar 45 by means of an L-shaped structural bracket 46 (FIG. 5) having a cutout 47 relieved to permit the motion of the dater block 20 toward the anvil 21. The bracket 46 is also shown in FIG. 5 where it is noted that the flap F is guided between the anvil 21 and an interior surface 48 of the bracket 46. Structural bracket 46 is connected to the tie bar 45 by means of welding or any suitable fastener (not shown).

In order to urge the dater block 20 toward the anvil 21 to brand the flap F at an appropriate time, an actuting cylinder 50 is provided. Cylinder 50 can be either hydraulic or pneumatic, but is preferably pneumatic. An electric solenoid may also be used. One pneumatic cylinder which is found to be useful is the double acting cylinder manufactured by the Bellows Balvair Company as model number BO2120051. This cylinder has an extensible piston 51 which has a forward end 52 thereon. Piston 51 is extensible forwardly, or to the left as viewed in FIG. 1, but is normally positively maintained in a retracted position as shown in FIG. 1. Cylinder 50 is mounted to tie bar 45 by way of a bracket 53 or in some otherwise suitable fashion such that piston 52 is disposed for motion generally toward the dater block 20 and the anvil 21.

In order to structurally isolate the pneumatic cylinder 50 from the heated dater block 20, an actuating rod 60, which is shorter than the distance from the forward end 52 of retracted piston 51 to the swing gate 30 of the dater block is interposed between the cylinder 50 and the dater block. The rod is slidably mounted for reciprocal motion within a guide tube 61 which is mounted to tie bar 45 by means of plate 61*a*. Guide tube 61 is a simple tube welded to plate 61*a* or an integral, bored block could be used. Due to the shortness of the actuating rod 60, it is seen in FIG. 1 that when the piston 51 is retracted, there is no effective mechanical connection between the forward end 52 of the piston and heater dater block 20. Of course, when the piston 51 is extended, the forward end 52 thereof engages the rearward end 62 of the rod 60 and urges the rod forwardly against the swing gate 30 of the dater block 20, thereby moving the date dies 26 in the dater block 20 into engagement with the carton flap F, backed up by anvil 21 as shown in FIG. 2. Since the actual branding operation is intermittent and only momentary, piston 51 contacts rod 60 only for a very short duration. The forward end 52 of the piston is retracted quickly and the space between the forward end 52 of the piston and the rearward end 62 of the rod thereby effectively normally isolates the piston and cylinder from heat conduction from the dater block 20.

The tie bar 45 is mounted on an upstanding support column 75 which extends downwardly and is connected to the frame member 42. An intermediate portion of the upstanding column 75 is connected to a mounting bracket 76 which extends rearwardly and is connected to an appropriate portion or frame component of the dairy machine 11 for filling and sealing cartons C. Mounting bracket 76 as shown is particularly useful with the Ex-Cell-O machine model number QL9000. However, other mounting brackets can be readily adapted for use with the branding apparatus in order to mount the branding apparatus in an appropriate position with respect to the carton conveying run 12 of the filling and sealing machine. In some cases, it is also preferable to mount a junction box 77, for example, on the mounting bracket 76, the junction box housing the electrical connections for the heater, or for a solenoid, for example, if used in place of cylinder 50.

In use, the actuating cylinder 50 is energized to extend piston 51 and, through the rod 60, to move the heated date slugs 26 against the carton flap F in order to brand the flap F with date indicia. In a typical installation, it is thus preferable to mount the branding apparatus 10 at a position along the conveying run 12 of the filling and sealing machinery such that it is operable to brand the flap F at a time when the carton is momentarily stopped at the location where the branding apparatus 10 is mounted. The particular structure of the branding apparatus 10, such that the leaf spring 40 and the upstanding support column 75 are spaced apart, permits the apparatus to be mounted in different types of filling and sealing machines where a return run 13 of the carton conveyor must be accommodated.

In the preferred embodiment, the cylinder is actuated by air pressure, controlled by a valve, which in turn is operated by a cam mounted on the line shaft of the filling machine. The cam is timed to actuate the cylinder at a time when the carton flap is momentarily stopped at the brander station between the dater block and anvil. A Bellows Balvair valve Model No. B3741006 is suitable for this purpose, however other suitable valves could be used. The valve is operable in one position to pass pressurized air to the cylinder to actuate it and extend the piston in another position, to retract the piston.

The preferred embodiment as described above results in a number of significant advantages. First, while the rod 60 is shorter than the distance between the retracted piston 51 and the dater block 20, it is significantly long enough to isolate the cylinder not only from conducted heat between the dater block and the piston, but from radiated heat of a degree which would degrade the seal or other components of the cylinder. This prolongs cylinder life.

Secondly, it should be noted that the guide tube 61 is relatively short in comparison with the rod 60 and also, that the piston 51 never engages or enters the guide tube 61. The bore through the guide tube accommodating the rod 60 is loose enough so that the rod slides freely within the guide tube. Since the piston 51 does not move into the guide tube, critical alignment tolerances are substantially eliminated, it only being necessary that the piston 51 be in general axial alignment with the rod 60. The piston 51 is thus free to extend from the cylinder 50 without binding or any stress in other than reciprocal direction of motion. Since the rod 60 is rather loosely held within the guide tube 61, it also does not bind but is freely movable toward the dater block 20. This promotes smoothness of operation and further extends the life of cylinder 50.

Since the rod 60 is shorter than the distance between the retracted piston 51 and the dater block 20, it can be moved rearwardly, toward the cylinder 50, in order to facilitate the removal and changing of the date dies or slugs 26. For example, in FIG. 3, the swing gate 30 is opened and date dies or slugs 26 are shown in a removed position, the forward end 63 of the rod 60 having been moved rearwardly enough to permit the ready removal of the date slugs 26 from the dater block 20. In normal position, however, it will be appreciated that the forward end 63 of the rod 60 is rather closely spaced, if not abutting, the swing gate 30, leaving a substantial space between the rearward end 62 of the rod and the forward end 52 of the retracted piston 51 as shown in FIG. 1. In this regard, when the piston 51 is retracted after a branding operation, the acting of spring 40 may snap the rod rearwardly so it normally does not engage dater block 20 (gate 30) and this keeps the rod cooler than if constantly in contact with the gate 30.

Accordingly, the branding apparatus incorporates means for structurally isolating the cylinder 50 from the heat of the dater block 20, yet permitting mechanical actuation of the dater block 20 by the cylinder 50 and toward the anvil 21 to produce the required brand in the flap F. Cylinder life is extended as a result of relatively cool operation and the relief of any binding or stressing on the piston 51 by virtue of the interposed rod and guide tube apparatus.

These and other advantages will become readily apparent to those of ordinary skill in the art, without departing from the scope of this invention, and applicant intends to be bound only by the claims appended hereto.

I claim:

1. In brander apparatus comprising a heated dater block means and anvil means, one of which is movably mounted with respect to the other, actuating means for moving one of said dater block means and said anvil means toward the other to brand a carton flap therebetween, said actuating means comprising:

a cylinder having a selectively extensible piston, a slidably mounted rod extending between said cylinder and one of said dater block means and said anvil means, said piston and said rod having respective axes in operative alignment with each other, said rod having a forward end and a rearward end, said forward end located proximate to but spaced from one of said dater block means and said anvil means, and said rearward end disposed proximate but spaced from said piston, said piston, when extended, engaging said rod at said rearward end, and said rod at said forward end engaging one of said dater block means and said anvil means for moving it toward the other when said piston is extended and for engaging it with a carton flap.

2. Apparatus as in claim 1 wherein said one of said dater block means and said anvil means is mounted at one end of a leaf spring in a normal unbiased position spaced from the other.

3. Apparatus as in claim 1 wherein said rod is shorter than the distance between said piston, when not extended, and said one of said dater block means and said anvil means.

4. Apparatus as in claim 3 wherein said movable one of said dater block means and said anvil means is disposed between a forward end of said rod and the other of said dater block means and said anvil means.

5. Apparatus as in claim 4 wherein said cylinder, said rod and an unmovable one of said anvil means and said data block means are operatively mounted on a common tie bar, and wherein the axis of said rod and of said piston is closely proximate to but spaced from and aligned with said tie bar.

6. Apparatus as in claim 5 wherein said dater block means is movably mounted between a forward end of said rod and said anvil means.

7. Apparatus as in claim 3 wherein said rod is slidably mounted within a guide tube shorter than said rod.

8. Apparatus as in claim 7 wherein said piston has a forward end extending to a position proximate a rearward end of said guide tube when said piston is extended.

9. Apparatus as in claim 5 further including a bracket for mounting on said tie bar said bracket being L-shaped and having one leg spaced from said anvil for receiving a carton flap between said bracket and said anvil.

10. Branding apparatus comprising:

a heated dater block means, an anvil means operatively disposed with regard to said dater block means, said dater block means being movably mounted for movement toward and away from said anvil means, spring means for biasing said dater block means away from said anvil means, a cylinder having a selectively extensible piston, a longitudinally slidable actuating rod operatively mounted between said piston and said dater block means, said rod and said piston being in substantial axial alignment, said rod being shorter than the distance between the piston when not extended and the dater block means and being respectively spaced at each end from said piston and said dater block, said piston, when extended, engaging a rearward end of said rod, pushing a forward end of said rod into engagement with said dater block means, and thereby pushing said dater block means, against the bias of said spring means, toward said anvil means to brand a carton flap therebetween.

11. Apparatus as in claim 10 wherein said anvil means, said rod and said cylinder are mounted on a tie bar in respective operative alignment.

12. Apparatus as in claim 11 wherein said heated dater block means is mounted on the upper end of a leaf spring and is normally spaced from said anvil means.

13. Apparatus as in claim 12 wherein said leaf spring is mounted at a lower end to a frame member.

14. Apparatus as in claim 13 wherein said tie bar is mounted on an upper end of a support column, a lower end of which is connected to said frame member.

15. Apparatus as in claim 14 wherein said support column is mounted to a mounting bracket adapted to connect said branding apparatus to a carton filling and sealing apparatus.

16. Apparatus as in claim 11 wherein said dater block means comprises a recess for receiving date dies having a predetermined length, and a swing gate for holding said date dies in said dater block, said rod engaging said swing gate when said piston is extended.

17. Apparatus as in claim 16 wherein said rod is movable away from said swing gate when said piston is retracted to permit said dates to be removed from said dater block means in a direction toward said cylinder.

18. Apparatus as in claim 11 further including a guide tube mounted on said tie bar and operatively aligned with said piston, said rod slidably disposed in said guide tube.

19. Apparatus as in claim 11 further including an L-shaped bracket having one leg attached to said tie bar and said anvil means attached to another leg.

20. Apparatus as in claim 19 wherein said bracket is attached to an end of said tie bar and is attached to said anvil means laterally of said tie bar.

21. Apparatus as in claim 20 wherein said dater block is disposed over said tie bar in alignment with said anvil means.

22. Apparatus as in claim 21 wherein said dater block is movable toward said anvil means beyond said end of said tie bar and said bracket.

23. Apparatus as in claim 22 wherein said piston and said rod are mounted above said tie bar and are in alignment therewith.

24. In apparatus for branding cartons including an anvil means, a heated dater block means and an actuating cylinder having a normally retracted, extensible piston for intermittently moving said dater block means toward said anvil to brand a carton flap therebetween, the improvement comprising means for structurally isolating said cylinder from said heated dater block means while permitting intermittent mechanical actuation of said heated dater block means toward said anvil means, said isolating means comprising:

a slidably mounted rod operatively disposed between said cylinder and said dater block means and axially aligned with said piston, said rod being shorter than the distance between said dater block means and said piston when said piston is retracted and being spaced from both said dater block means and said piston, and further including a guide tube aligned with said piston and shorter than said rod, said rod slidably disposed in said guide tube.

25. Apparatus as in claim 24 wherein said anvil means, guide tube and cylinder are mounted on a tie bar and said heated dater block means is mounted on a leaf spring, spaced from said tie bar.

26. Apparatus as in claim 25 wherein said tie bar is mounted on a support column connected to a frame member at a lower end thereof and wherein a lower end of said leaf spring is connected to said frame member.

27. Apparatus as in claim 26 further including bracket means for mounting said branding apparatus on a milk carton filling and sealing apparatus.

28. Apparatus as in claim 25 wherein said piston and said rod are aligned with said tie bar.

* * * * *

UNITED STATES PATENT AND TRADEMARK OFFICE

CERTIFICATE OF CORRECTION

PATENT NO. : 4,204,469

DATED : May 27, 1980

INVENTOR(S) : John A. Johnson

It is certified that error appears in the above-identified patent and that said Letters Patent are hereby corrected as shown below:

Col. 7 Line 7 "data" should be --dater--

Signed and Sealed this

*Fifth* Day of *August 1980*

[SEAL]

*Attest:*

SIDNEY A. DIAMOND

*Attesting Officer*

*Commissioner of Patents and Trademarks*